United States Patent [19]

Gregory

[11] 4,433,891

[45] Feb. 28, 1984

[54] SUPPORT FOR CURRENT CARRYING MEMBER

[75] Inventor: George D. Gregory, Isla Verde, P.R.

[73] Assignees: Challenger Caribbean Corporation, Canovanas; Challenger Products Corporation, Rio Piedras, both of P.R.; Commander Electrical Equipment, Inc., Scarborough, Canada

[21] Appl. No.: 357,007

[22] Filed: Mar. 11, 1982

[51] Int. Cl.[3] ..... H01C 3/08

[52] U.S. Cl. ..... 339/217 R; 339/263 R; 339/277 R

[58] Field of Search ..... 339/217 R, 217 PS, 249 R, 339/263 R, 263 L, 277 R, 225

[56] References Cited

U.S. PATENT DOCUMENTS

| | | | |
|---|---|---|---|
| 2,928,066 | 3/1960 | Gordon | 339/198 G |
| 3,771,100 | 11/1973 | Reed | 339/217 R |
| 3,793,607 | 2/1974 | Smith et al. | 339/217 R |
| 3,848,161 | 11/1974 | Clement | 339/198 N |
| 3,915,544 | 10/1975 | Yurtin | 339/217 R |
| 4,042,289 | 8/1977 | Heinonen et al. | 339/176 M X |
| 4,171,152 | 10/1979 | Geisler | 330/198 G |

*Primary Examiner*—William R. Briggs

*Attorney, Agent, or Firm*—Frederick A. Zoda; John J. Kane

[57] ABSTRACT

A bus bar is held at the peripheral portion of a molded plastic housing by means of a formed metallic support having a single tab along an edge thereof and a pair of spaced apart tabs along an opposite edge thereof. the support has an oval hole therein so that the bus bar can be affixed thereto. The molded plastic housing has a pair of opposed walls at the peripheral portion. One wall has a vertical groove from its top to a bottom stop, so that the single tab can rest therein. The other wall has a first vertical groove from its top to a bottom stop (level with the first bottom stop) and a second vertical groove from the bottom of the wall to a top stop. The top stop is located above the bottom stops by a distance equal to the thickness of the support. The support rests within the grooves of the housing, and holds the bus bar.

7 Claims, 16 Drawing Figures

SUPPORT FOR CURRENT CARRYING MEMBER

BACKGROUND OF THE INVENTION

1. Field of the Invention

This invention relates to a support for a current carrying member exiting a molded housing, and to a combination including such support and a molded housing formed for holding such support. Accordingly, it is a general object of this invention to provide new and improved supports and combinations of such character.

2. Description of the Prior Art

Pursuant to the duty of candor and good faith toward the Patent and Trademark Office, as set forth at 37 CFR 1.56, the following United States Patents may be material to the examination of this application. Although applicant does not admit that a novelty search has in fact been performed, such patents were called to his attention by virtue of a search performed on his behalf.

| U.S. Pat. No. | Patentee(s) | Issue Date |
|---|---|---|
| 2,928,066 | Gordon | March 8, 1960 |
| 3,793,607 | Smith et al. | Feb. 19, 1974 |
| 3,848,161 | Clement | Nov. 12, 1974 |
| 4,042,289 | Heinonen et al. | Aug. 16, 1977 |

Gordon, U.S. Pat. No. 2,928,066 relates to an electrical terminal block of high dielectric material, such as molded nylon. One side of the block contains a plurality of protruding, partially cylindrical tongues; the opposite side of the block contains a like plurality of partially cylindrical recesses. Each recess and each cylinder has a cross-section which defines an interrupted circle having an arc greater than 180 degrees. A pair of blocks, thus, are forced together. Disassembly is achieved by pulling apart. Disadvantageously, it is not designed for supporting a current carrying terminal bar that exits a molded housing. It is not designated for permitting electrical connection at the top or bottom, as desired, by means of the support itself becoming an intermediary current carrying member when the connection may be on the bottom.

Smith et al., U.S. Pat. No. 3,793,607, in part, discloses a contact including a hole, a projection on one side thereof, and two projections on the opposite side thereof. Disadvantageously, there is no suggestion for supporting a terminal bus, nor for providing electrical connection to top or bottom (or front or back). Further, there is no suggestion in Smith et al. of three slots in a housing, with two slots oriented in one direction, and the third slot oriented in the opposite direction.

Clement, U.S. Pat. No. 3,848,161, in part, discloses molded supports for a pair of bus bars. However, the supports do not provide for electrical connection therewith. There is no suggestion relating to the support of a terminal bar which exits a housing.

Heinonen et al., U.S. Pat. No. 4,042,289, relates to a plug contact device intended for mounting on circuit cards. Tips of contact springs are received by slits in an insulated body. Disadvantageously, there is no suggestion for supporting a terminal bar that exits from a housing. There is no suggestion to permit electrical connection from top and bottom.

SUMMARY OF THE INVENTION

Another object of this invention is to provide for a new and improved support for a current carrying terminal bar that exits from a molded housing.

Still another object of this invention is to provide for a new and improved support for permitting electrical connection to the top or bottom thereof, with the support when the connection is on the bottom.

Yet another object of the invention is to provide for a new and improved support which enables the movement of the terminal bar to be restricted in all directions relative to a molded housing.

In accordance with a preferred embodiment of the invention, a support for insertion into guideways of a housing includes a metallic sheet having an oval hole therein. A single tab extends outwardly along a first direction, and two additional spaced apart tabs extend outwardly from the sheet in the opposite direction.

In accordance with another embodiment of the invention, the metallic sheet is generally rectangular with four corners and four sides. A single tab extends outwardly from one of the sides, and two additional spaced apart tabs extend outwardly from a second side, the second side being parallel to the one side. With certain features of the invention, the aforesaid one side has a maximum of a single tab. The tabs are located along portions of the sides other than at the corners of the sheet. The sheet can be formed of copper coated with tin.

With another embodiment of the invention, a combination can include a molded plastic housing and a support. The housing has internal and peripheral portions set apart by a separation wall that is provided with a horizontal slot. The peripheral portion is provided with two opposing walls extending from the separation wall. One of the opposing walls is provided with a vertical groove from its top to a horizontal plane oriented just below the bottom of the slot. The other opposing wall is provided with a first vertical groove from its top to the horizontal plane and with a second vertical groove from its bottom to a location level with the bottom of the slot. The support, insertable into the grooves of the opposing walls, includes a metallic sheet. The sheet has an oval hole therein, a single tab which extends outwardly from the sheet so as to be engageable with the vertical groove of the one opposing wall, and two additional spaced apart tabs which extend outwardly from the sheet, in a direction opposite to that of the single tab, so as to be engageable with the vertical grooves of the other opposing wall. In accordance with certain features of the invention, the opposing walls are arallel, and, when the support is engaged with the housing, a top surface of the support is flush with the bottom of the slot. The horizontal plane can be located at a distance below the bottom of the slot equal to the thickness t of the metallic sheet.

In accordance with yet another embodiment of the invention, a combination includes a molded plastic housing and a support. The housing has internal and peripheral portions set apart by a separation wall that is provided with a horizontal slot. The peripheral portion is provided with two parallel opposing walls extending perpendicularly from the separation wall. One opposing wall is provided with a vertical groove from its top to a horizontal plane oriented a distance t below the bottom of the slot. The other opposing wall is provided with a first vertical groove from its top to the horizontal plane, and with a second vertical groove from its bottom to a location level with the bottom of the slot. The support, insertable into the grooves of the opposing walls, includes a generally rectangular metallic sheet having a thickness t, four corners, and four sides, and having an oval hole, a single tab that extends outwardly from one side so as to be engageable with the vertical groove of an opposing wall, and two additional spaced apart tabs extend outwardly from a parallel side so as to be engageable with the vertical grooves of the other opposing wall. When the support is engaged with the housing, a top surface of the support is flush with the bottom of the slot.

Other embodiments of the invention include a combination including a molded plastic housing, a support, a terminal member, a conductive device, and fastening means. The housing has internal and peripheral portions set apart by a separation wall provided with a horizontal slot. The peripheral portion has two parallel opposing walls extending perpendicularly from the separation wall. One opposing wall is provided with a vertical groove molded in an upward direction with a bottom stop. The other opposing wall is provided with a first vertical groove molded in an upward direction with a bottom stop, and with a second vertical groove molded in a downward direction with a top stop level with the bottom of the slot. Both bottom stops lie in a horizontal plane oriented a distance t below the horizontal slot. The support, insertable into the grooves, includes a generally rectangular metallic sheet having a thickness t, four corners, and four sides. The sheet has an oval hole, a single tab extending outwardly from one side, and two additional spaced apart tabs extending outwardly from an opposite side, so that the three tabs are engageable with the vertical grooves of the opposing walls. Upon engagement, with the housing, a top surface of the support becomes flush with the bottom of the slot. The terminal member, substantially flat, extends between the internal and peripheral portions, partially resides within the slot, has a circular hole, and means for affixing an internal portion thereof to the housing. The circular hole can be aligned over the oval hole. In one of the embodiments, the conductive device is an upper bus bar having a circular hole at one end for alignment over the circular hole of the terminal member, and having an opposite end for usage distant from the housing. The fastening means fastens the upper bus bar, the flat terminal member, and the support in a sandwich relation from top to bottom in the order named. In a second embodiment, the conductive device is a lower bus bar having a circular hole at one end for alignment under the oval hole of the support, and having an oppsite end for usage distant from the housing. The fastening means fastens the flat terminal member, the support, and the lower bus bar in a sandwich relation from top to bottom in the order named. In a third embodiment, the flat terminal member has an alignment slot located within its peripheral portion. The conductive device is a generally parallelepiped wire connector having an alignment projection for engagement with the alignment slot of the terminal member. The wire connector has a first hole passing from front to rear so that a conductive wire could be inserted thereinto. The connector has a second hole at its bottom for alignment over the circular hole of the terminal member. The connector has a top threaded hole, with a threaded nut therewithin, for securely fastening the conductive wire thereto. The fastening means fastens the wire connector, the flat terminal member, and the support in a sandwich relation from top to bottom in the order named.

BRIEF DESCRIPTION OF THE DRAWING

Other objects, advantages, and features of this invention, together with its construction and mode of operation, will become more apparent from the following description, when read in conjunction with the accompanying drawing, in which.

DESCRIPTION OF PREFERRED EMBODIMENT(S)

Figure 1:
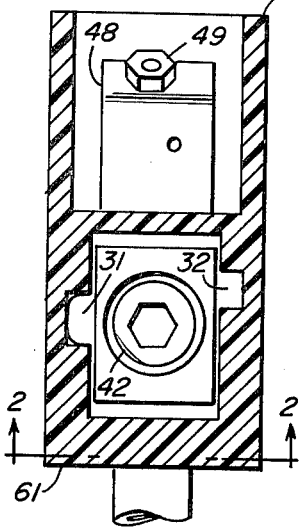
FIG. 1 is a top view of one embodiment of the invention including a wire connector, taken along the line 1—1 of FIG. 2.

As indicated hereinabove, FIGS. 1—3, FIGS. 4—6, and FIGS. 7—9 depict three different embodiments of the invention. They include a novel support 21, which is generally rectangular in shape, having four corners 22, 23, 24, 25 and four sides 26, 27, 28, 29. One side 29 has a single projection or tab 31 protruding therefrom; the opposite side 27 has a pair of extending spaced apart projections or tabs 32, 33. An oval hole 33 is located in the center of the metallic sheet 21.

The support 21, which can hold a current carrying member, is preferably formed from a sheet of conductive material such as copper coated with tin. When the support 21 is inserted into a housing, a current carrying bus bar having a circular hole can be aligned with the support for affixation by means of a fastening device, such as a nut and bolt.

The support 21 can be used in association with a molded plastic housing 41 in various combinations as indicated in the drawing. The combination shown in FIGS. 1—3 utilizes a wire connector 42; the version shown in FIGS. 4–6 utilizes an upper bus bar 43; and the version depicted in FIGS. 7–9 utilizes a bottom bus bar 44.

Figure 2:
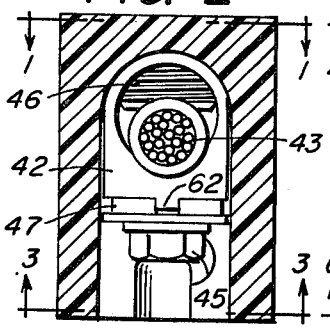
FIG. 2 is a front view of the embodiment shown in FIG. 1, taken along the line 2—2 thereof.
Figure 3:
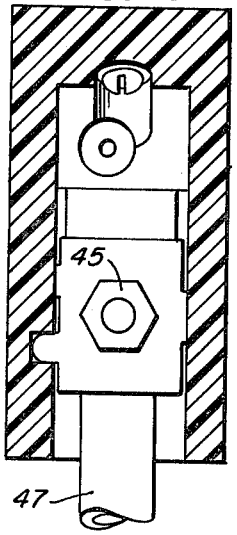
FIG. 3 is a bottom view of the embodiment shown in FIG. 1, taken along the line 3—3 of FIG. 2.
Figure 10:
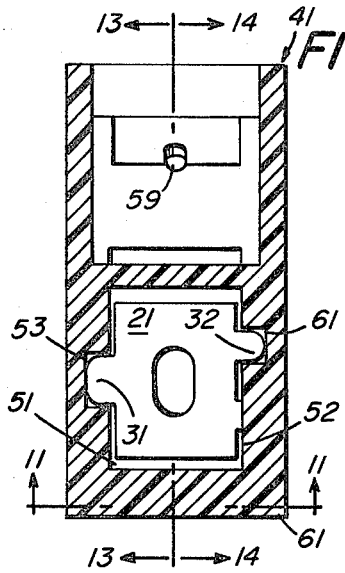
FIG. 10 is a top view of a molded plastic housing showing a support in accordance with an embodiment of this invention, taken along the line 10—10 of FIG. 11.
Figure 13:
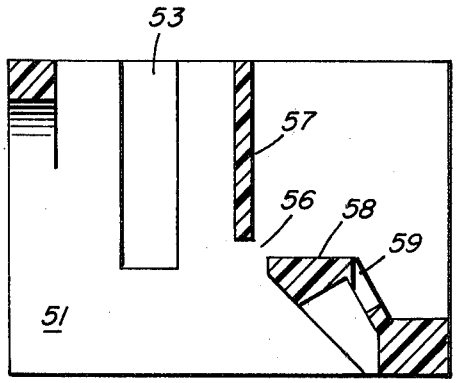
FIG. 13 is a sectional view of the molded housing shown in FIG. 10, with the support deleted, taken along the line 13—13 thereof.
Figure 11:
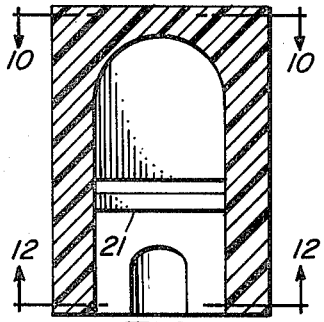
FIG. 11 is a front view of the structure shown in FIG. 10, taken along the line 11—11 thereof.
Figure 14:
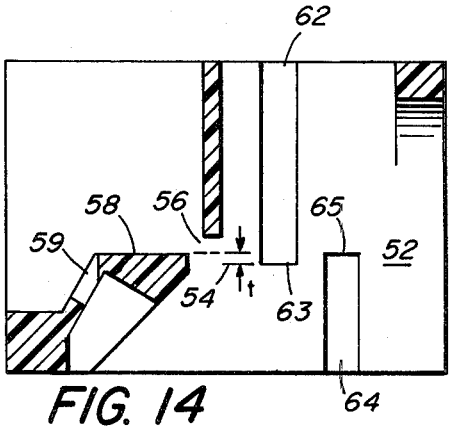
FIG. 14 is a sectional view of the molded housing shown in FIG. 10, with the support deleted, taken along the line 14—14 thereof.
Figure 12:
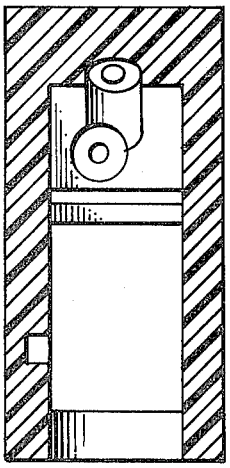
FIG. 12 is a bottom view of the structure shown in FIG. 10, taken along the line 12—12 of FIG. 11.

Referring to the embodiment depicted in FIGS. 1–3 inclusive, the wire connector 41 includes a hole 43 which runs therethrough from front to rear thereof (FIG. 2). The connector 42 is provided with a bottom hole (not shown) so that a nut and bolt 45 can be applied thereto. The top of the wire connector 42 has a threaded hole so that a threaded nut 46 can be inserted therein for holding a cable 47. A substantially flat terminal member 48 is affixed at the internal portion of the housing 41 by a nut and bolt 49. The support 21 can be inserted into the housing 41 by inserting the tabs 32, 33 into appropriate guideways or vertical grooves therein. Referring to FIG. 10, the housing 41 includes a pair of opposing walls 51, 52. FIGS. 13 and 14 are sectional views depicting the opposing walls 51, 52, respectively. The opposing wall 51 includes a vertical groove 53 which runs from the top of the molded plastic housing 41 down to a horizontal plane 54 located just below the bottom of a horizontal slot 56. The horizontal slot 56 is delinated by a vertical separation wall 57 which runs from the top of the molded plastic housing 41 to a point above the horizontal plane 54. The horizontal plane 54, just below the bottom of the horizontal slot 56, is delinated by another portion 58 of the housing 41. The distance t from the bottom of the horizontal slot to the horizontal plane 54 is preferably equal to the thickness of the support 21. The molded plastic housing 41, as indicated in FIGS. 10, 13, and 14, is provided with a hole so that a nut and bolt 49 can hold the substantially flat terminal member 48 thereto.

Referring to FIG. 14, a first vertical groove 62, which acts as a guideway, is oriented from the top of the molded housing 41 down to the horizontal plane 54. The horizontal plane 54 again is located a distance t below the bottom of the slot 56. The bottom stop 63 of the vertical groove 62 is located at the horizontal plane 54. A second vertical groove 64, along the wall 52, is oriented from the bottom of the molded housing 41 up to a top stop 65, the top stop 65 being level with the bottom of the horizontal slot 56.

In operation, the support 21 is inserted into the peripheral portion 61 of the molded plastic housing 41 by inserting the two spaced apart tabs 32, 33 into the vertical grooves 62, 64, respectively, whereby the two tabs 32, 33 reside at the stops 63, 65, respectively. The tab 31 is then permitted to rest at the bottom stop 65, which is oriented at the horizontal plane 54 of the vertical groove 53 located at the opposing wall 51. With such orientation, the support 21 resides at the respective grooves 62, 64, 53, as indicated in FIG. 10.

The substantially flat terminal member 48, held by the fastening means 49 at the internal portion of the housing 41, extends into the peripheral portion 61 and is provided with an alignment slot 61 therein. Thus, with regard to the embodiment depicted in FIGS. 1–3, the generally rectangular parallelepiped wire connector 42 can be aligned with the substantially flat terminal member 48 by means of an alignment projection 62 which engages with the alignment slot 61 of the terminal member 48 as depicted in FIG. 2.

Figure 4:
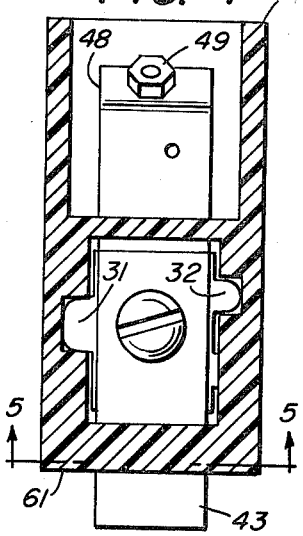
FIG. 4 is a front view of a second embodiment of the invention including an upper bus bar, taken along the line 4—4 of FIG. 5.
Figure 5:
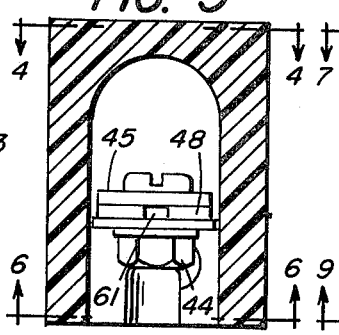
FIG. 5 is a front view of the embodiment shown in FIG. 4, taken along the line 5—5 thereof.
Figure 6:
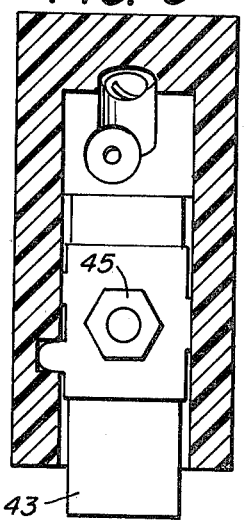
FIG. 6 is a bottom view of the embodiment shown in FIG. 4, taken along the line 6—6 of FIG. 5.
Figure 15:
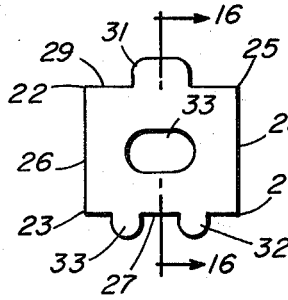
FIG. 15 is a plan view of a metallic support in accordance with a preferred embodiment of the invention.
Figure 16:
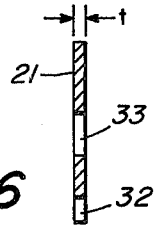
FIG. 16 is a sectional view taken along the line 16—16 of FIG. 15.

Referring to FIGS. 4–6 inclusive, the embodiment includes the molded plastic housing with the configuration depicted in FIGS. 13, 14 together with the support 21 as depicted in FIGS. 15, 16. The terminal member 48 is held in place by the fastening means 49 at the internal portion (FIGS. 4–6). The peripheral portion of the fastening means 48 is held above the support 21 with a circular hole in the means 48 in alignment with the oval hole of the support 21. The upper bus bar 43 is placed on top of the fastening member 48. Thus, FIG. 5, the upper bus bar 43, the substantially flat terminal member 48, and the support member 21 are arranged in sandwich relation from top to bottom in the order named. The sandwich is held together by an appropriate nut and bolt assembly 44.

Figure 7:
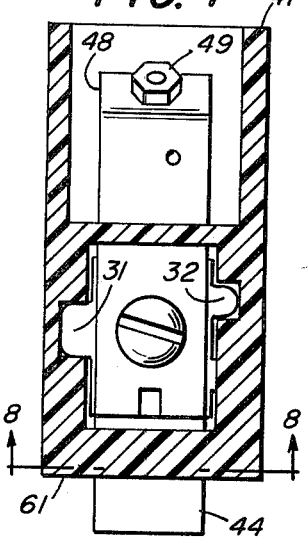
FIG. 7 is a top view of another embodiment of the invention including a lower bus bar, taken along the line 7—7 of FIG. 8.
Figure 8:
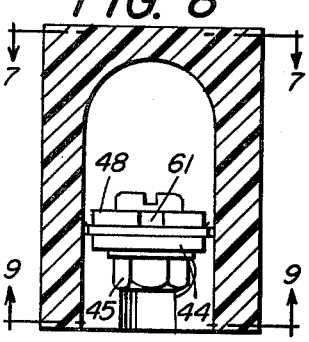
FIG. 8 is a front view of the embodiment shown in FIG. 7, taken along the line 8—8 thereof.
Figure 9:
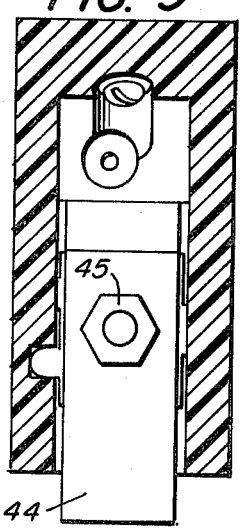
FIG. 9 is a bottom view of the embodiment shown in FIG. 7, taken along the line 9—9 of FIG. 8.

Referring to FIG. 7–9, there is depicted a substantially similar combination. A lower bus bar 44 is utilized in lieu of an upper bus bar 43. Hence, the overall combination includes the substantially flat terminal member 48, the support 21, and the lower bus bar 44. The sandwich of the flexible member 48, the support 21, and lower bus bar 44 is held together by an appropriate means 45.

To summarize:

In the wire connector 42 embodiment, the support 21 is inserted into the grooves 62, 64, 53 of the housing 41. A bus bar 43 is inserted through the housing overlying the support 21. The wire connector 42, inserted thereabove, fits into the groove 61 in the upper bus bar 48 so as to be aligned therewith. The wire connector 42 is bolted to the support and the upper bus bar 48 via a nut and bolt.

With the upper bus bar connection depicted in FIGS. 4–6, the support 21 is on the bottom, the current carrying member or flexible terminal member 48 is immediately thereabove, and the upper bus bar 43 which extends away from the housing 41 overlies the member 48. The three are joined together by an appropriate nut and bolt 45.

With regard to the lower bus bar connection, the current carrying member is on the top, the support is in the center and the lower bus bar 44 is on the bottom.

Other modifications can be performed without departing from the spirit and scope of this invention. For example, the support need not be generally rectangular in shape, but can be oval or another appropriate configuration.

What is claimed is:

1. In combination, a molded plastic housing having internal and peripheral portions set apart by a separation wall of said housing, said wall being provided with a horizontal slot therein, said peripheral portion being provided with two opposing walls extending from said separation wall, one of said opposing walls being provided with a vertical groove from the top thereof to a horizontal plane, said horizontal plane being oriented just below the bottom of said horizontal slot, the other of said opposing walls being provided with a first vertical groove from the top thereof to said horizontal plane and with a second vertical groove from the bottom thereof to a location level with the bottom of said slot; and a support for insertion into said grooves of said opposing walls including a metallic sheet having an oval hole therein, a single tab extending outward from said sheet along a first direction so as to be engageable with said vertical groove of said one opposing wall, and two additional spaced apart tabs extending outwardly from said sheet along a direction opposite to said first direction so as to be engageable with said vertical grooves of said other of said opposing walls.

2. The combination as recited in claim 1 wherein said opposing walls are parallel to each other, and wherein, when said support is engaged with said housing, a top surface of said support is flush with the bottom of said slot.

3. The combination as recited in claim 1 wherein said horizontal plane is located a distance t below the bottom of said horizontal slot, and wherein said metallic sheet has a thickness of said t.

4. In combination, a molded plastic housing having internal and peripheral portions set apart by a separation wall of said housing, said wall being provided with a horizontal slot therein, said peripheral portion being provided with two parallel opposing walls extending perpendicularly from said separation wall, one of said opposing walls being provided with a vertical groove from the top thereof to a horizontal plane, said horizontal plane being oriented a distance t below the bottom of said horizontal slot, the other of said opposing walls being provided with a first vertical groove from the top thereof to said horizontal plane and with a second vertical groove from the bottom thereof to a location level with the bottom of said slot; and a support for insertion into said grooves of said opposing walls including a generally rectangular metallic sheet having a thickness of said t, four corners, and four sides, and having an oval hole therein, a single tab extending outwardly from one of said four sides so as to be engageable with said vertical groove of said one opposing wall, and two additional spaced apart tabs extending outwardly from a second of said four sides, said second side being parallel to said one side, so as to be engageable with said vertical grooves of said other of said opposing walls, whereby when said support is engaged with said housing, a top surface of said support is flush with the bottom of said slot.

5. In combination, a molded plastic housing having internal and peripheral portions set apart by a separation wall of said housing, said wall being provided with a horizontal slot therein, said peripheral portion being provided with two parallel opposing walls extending perpendicularly from said separation wall, one of said opposing walls being provided with a vertical groove molded in an upward direction with a bottom stop lying in a horizontal plane, said horizontal plane being oriented a distance t below the bottom of said horizontal slot, the other of said opposing walls being provided with a first vertical groove molded in an upward direction with a bottom stop lying in said horizontal plane and with a second vertical groove molded in a downward direction with a top stop level with the bottom of said slot;

a support for insertion into said grooves of said opposing walls including a generally rectangular metallic sheet having a thickness of said t, four corners, and four sides, and having an oval hole therein, a single tab extending outwardly from one of said four sides so as to be engageable with said vertical groove of said one opposing wall, and two additional spaced apart tabs extending outwardly from a second of said four sides, said second side being parallel to said one side, so so to be engageable with said vertical grooves of said opposing walls, whereby, upon engagement with said housing, a top surface of said support becomes flush with the bottom of said slot;

a substantially flat terminal member extending between said internal portion and said peripheral portion, partially residing within said slot, having a circular hole therewithin for alignment over said oval hole, and having means for affixing an internal portion of said member to said housing;

an upper bus bar having a circular hole at one end thereof for alignment over said circular hole of said terminal member, and having an opposite end for usage distant from said housing; and fastening means for fastening said upper bus bar, said flat terminal member, and said support in a sandwich relation from top to bottom in the order named.

6. In combination, a molded plastic housing having internal and peripheral portions set apart by a separation wall of said housing, said wall being provided with a horizontal slot therein, said peripheral portion being provided with two parallel opposing walls extending perpendicularly from said separation wall, one of said opposing walls being provided with a vertical groove molded in an upward direction with a bottom stop lying in a horizontal plane, said horizontal plane being oriented a distance t below the bottom of said horizontal slot, the other of said opposing walls being provided with a first vertical groove molded in an upward direction with a bottom stop lying in said horizontal plane and with a second vertical groove molded in a downward direction with a top stop level with the bottom of said slot;

a support for insertion into said grooves of said opposing walls including a generally rectangular metallic sheet having a thickness of said t, four corners, and four sides, and having an oval hole therein, a single tab extending outwardly from one of said four sides so as to be engageable with said vertical groove of said one opposing wall, and two additional spaced apart tabs extending outwardly from a second of said four sides, said second side being parallel to said one side, so as to be engageable with said vertical grooves of said opposing walls, whereby, upon engagement with said housing, a top surface of said support becomes flush with the bottom of said slot;

a substantially flat terminal member extending between said internal portion and said peripheral portion, partially residing within said slot, having a circular hole therewithin for alignment over said oval hole, and having means for affixing an internal portion of said member to said housing;

a lower bus bar having a circular hole at one end thereof for alignment under said oval hole of said support, and having an opposite end for usage distant from said housing; and fastening means for fastening said flat terminal member, said support, and said lower bus bar in a sandwich relation from top to bottom in the order named.

7. In combination, a molded plastic housing having internal and peripheral portions set apart by a separation wall of said housing, said wall being provided with a horizontal slot therein, said peripheral portion being provided with two parallel opposing walls extending perpendicularly from said separation wall, one of said opposing walls being provided with a vertical groove molded in an upward direction with a bottom stop lying in a horizontal plane, said horizontal plane being oriented a distance t below the bottom of said horizontal slot, the other of said opposing walls being provided with a first vertical groove molded in an upward direction with a bottom stop lying in said horizontal plane and with a second vertical groove molded in a downward direction with a top stop level with the bottom of said slot;

a support for insertion into said grooves of said opposing walls including a generally rectangular metallic sheet having a thickness of said t, four corners, and four sides, and having an oval hole therein, a single tab extending outwardly from one of said four sides so as to be engageable with said vertical groove of said one opposing wall, and two additional spaced apart tabs extending outwardly from a second of said four sides, said second side being parallel to said one side, so as to be engageable with said vertical grooves of said opposing walls, whereby, upon engagement with said housing, a top surface of said support becomes flush with the bottom of said slot;

a substantially flat terminal member extending between said internal portion and said peripheral portion, partially residing within said slot, having a circular hole therewithin for alignment over said oval hole and having an alignment slot located within a peripheral portion thereof, and having means for affixing an internal portion of said member to said housing;

a generally parallelepiped wire connector having an alignment projection adapted to engage with said alignment slot, said wire connector having a first hole from a front of said connector to a rear of said connector so that a conductive wire could be inserted thereinto, said connector having a second hole oriented at the bottom of said connector for alignment over said circular hole of said terminal member, said connector having a top threaded hole with a threaded nut therewithin for securely fastening said conductive wire thereto; and fastening means for fastening said wire connector, said flat terminal member, and said support in a sandwich relation from top to bottom in the order named.

* * * * *

UNITED STATES PATENT AND TRADEMARK OFFICE

CERTIFICATE OF CORRECTION

PATENT NO. : 4,433,891

DATED : Feb. 28, 1984

INVENTOR(S) : George D. Gregory

It is certified that error appears in the above-identified patent and that said Letters Patent are hereby corrected as shown below:

Column 1, Lines 28 and 29, the issue date of "Aug. 16, 1977" should be located under the right hand column entitled "Issue Date"

Column 1, Line 42, change "designated" to -- designed --

Column 2, Line 9, before "when" insert -- itself becoming an intermediary current carrying member --

Column 2, Line 52, change "arallel" to -- parallel --

Column 5, Line 9, change "41" to -- 42 --

Signed and Sealed this

Sixth Day of November 1984

[SEAL]

*Attest:*

*Attesting Officer*

GERALD J. MOSSINGHOFF

*Commissioner of Patents and Trademarks*